US008047370B2

(12) United States Patent
Ma et al.

(10) Patent No.: US 8,047,370 B2
(45) **Date of Patent: *Nov. 1, 2011**

(54) PACKING CUSHION

(75) Inventors: Jun Ma, Shenzhen (CN); Qian Li, Shenzhen (CN); Xin-Yue He, Shenzhen (CN); Wan-Ling Shih, Taipei Hsien (TW)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/760,739

(22) Filed: Apr. 15, 2010

(65) Prior Publication Data

US 2010/0326873 A1 Dec. 30, 2010

(30) Foreign Application Priority Data

Jun. 26, 2009 (CN) ..... 2009 2 0305175 U

(51) Int. Cl.
*B65D 81/02* (2006.01)
*B65D 81/05* (2006.01)

(52) U.S. Cl. ..... 206/521; 206/592; 206/586

(58) Field of Classification Search ..... 206/251, 206/523, 586, 583, 587, 453, 588, 590–592, 206/594, 320, 521

See application file for complete search history.

(56) References Cited

U.S. PATENT DOCUMENTS

| | | | | |
|---|---|---|---|---|
| 5,515,976 | A * | 5/1996 | Moren et al. | 206/586 |
| 5,678,692 | A * | 10/1997 | Gratz | 206/453 |
| 5,706,951 | A * | 1/1998 | Oinuma et al. | 206/710 |
| 6,082,546 | A * | 7/2000 | Liao et al. | 206/592 |
| 6,105,765 | A * | 8/2000 | Chu | 206/320 |
| 6,123,199 | A * | 9/2000 | Madsen | 206/586 |
| 7,044,303 | B2 * | 5/2006 | Van Der Werf | 206/586 |
| 2001/0020595 | A1 * | 9/2001 | Koike | 206/521 |
| 2004/0094448 | A1 * | 5/2004 | Koike | 206/521 |
| 2004/0168953 | A1 * | 9/2004 | Van Der Werf | 206/586 |
| 2007/0175779 | A1 * | 8/2007 | Imai | 206/308.3 |

* cited by examiner

*Primary Examiner* — Steven A. Reynolds
(74) *Attorney, Agent, or Firm* — Altis Law Group, Inc.

(57) ABSTRACT

A packing cushion includes a base and a plurality of sidewalls coupled to the base. The plurality of sidewalls interconnect with each other and cooperate with the base to form an accommodating space. A first and second cushion portions protrude from an inner surface of the base in the accommodating space. The first cushion portion has a first inclined surface, the second cushion portion has a second inclined surface. The second inclined surface is parallel to the first inclined surface. A contour defined by the first inclined surface matches with at least a part of an object packed in the packing cushion. When the object is packed in the accommodating space, the first inclined surface contacts with at least a part of the object to provided a first cushioning, and when the object is subjected to impact forces to deform the first cushion portion, the second inclined contacts with the object to provided a second cushion.

15 Claims, 2 Drawing Sheets

PACKING CUSHION

BACKGROUND

1. Technical Field

The present disclosure relates to packing cushions for stabilizing an object when packed.

2. Description of Related Art

In general, various products are boxed up for shipping and storage. However, many products are frangible and easily damaged during shipping if packed in a box directly without filler or padding. Therefore, packing cushions or the like are needed in the boxes to protect the products.

BRIEF DESCRIPTION OF THE DRAWINGS

The components of the drawings are not necessarily drawn to scale, the emphasis instead being placed upon clearly illustrating the principles of the embodiments of a packing cushion. Moreover, in the drawings, like reference numerals designate corresponding parts throughout several views.

DETAILED DESCRIPTION

Figure 1:
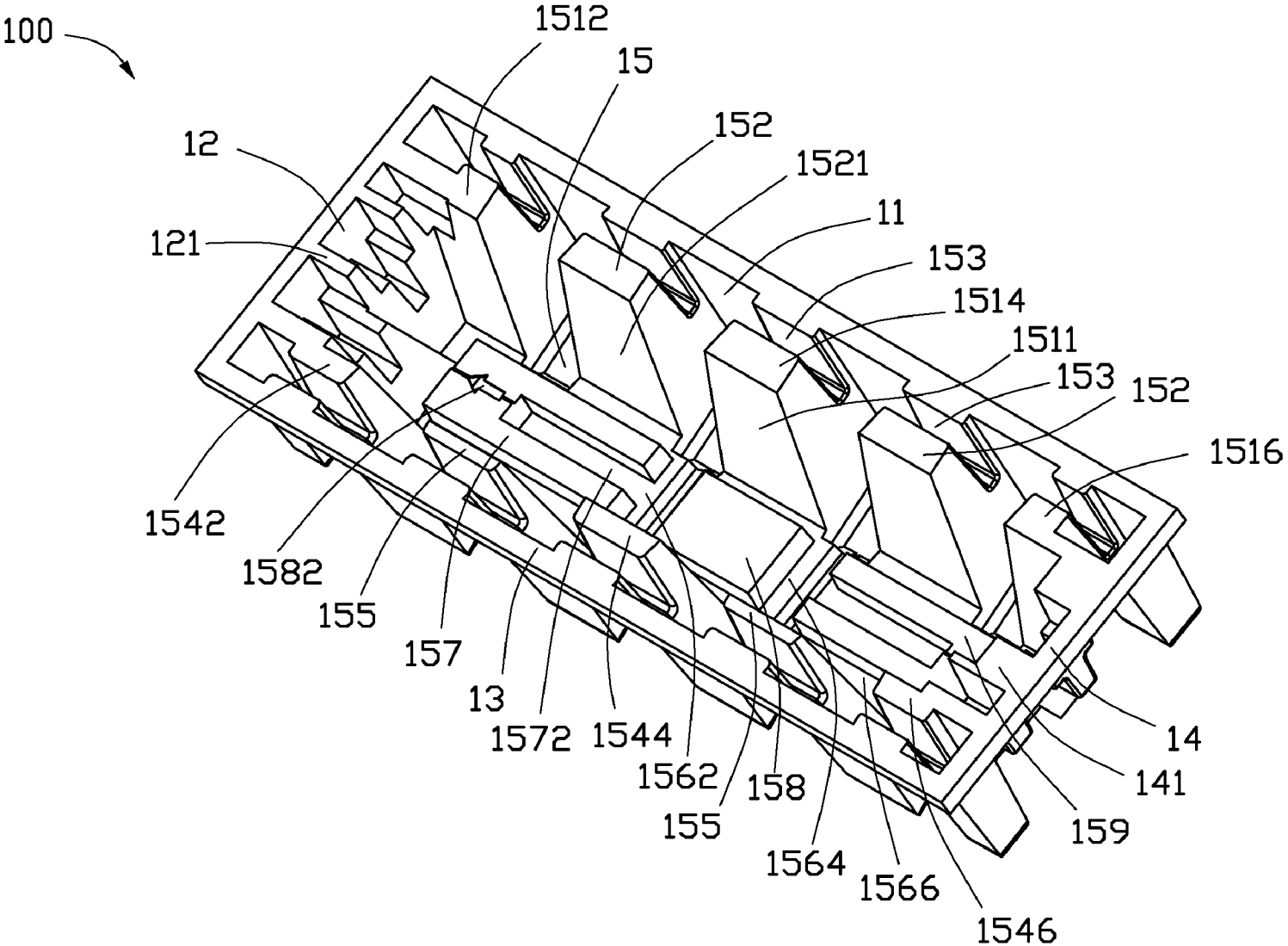
FIG. 1 is a perspective view of a packing cushion in accordance with one embodiment.

Referring to FIG. 1, a packing cushion 100 in accordance with an exemplary embodiment is shown. The packing cushion 100 can be used in boxes or other shipping containers to protect objects from shocks and vibrations during shipping. The packing cushion 100 is made of flexible materials. In the embodiment, the packing cushion 100 is made of pulp based material such as cardboard.

The packing cushion 100 is substantially a hexahedron. The packing cushion 100 includes a rectangular base 15, and four sidewalls (hereinafter, a first sidewall 11, a second sidewall 12, a third sidewall 13, and a fourth sidewall 14) protruding from four rims of the base 15. The first sidewall 11, the second sidewall 12, the third sidewall 13 opposite to the first sidewall 11, and the fourth sidewall 14 opposite to the second sidewall 12 are serially interconnected with each other to define an accommodating space to receive an object, e.g., an electronic device, therein.

A plurality of protrusions 121, 141 protrude from inner surfaces of the second and fourth sidewalls 12, 14 respectively, to provide cushioning for the electronic device. The protrusions 121, 141 are further connected to the base 15.

Three first protruding blocks 1512, 1514, and 1516 protrude from an inner surface of the base 15 and face the first sidewall 11. The first protruding block 1512 adjacent to the second sidewall 12 is coupled to the protrusion 121 of the second sidewall 12. The first protruding block 1516 adjacent to the fourth sidewall 14 is coupled to the protrusion 141 of the fourth sidewall 14. The first protruding block 1514 is arranged in the middle of the first protruding block 1512, and 1516. The shapes of the protruding blocks 1512, 1514, and 1516 are different from each other, but each of them define a first inclined surface 1511. Each first inclined surface 1511 faces the third sidewall 13, and extends upwardly from the base 15 in a direction substantially the same as the direction the first sidewall 11 extends from the base 15. The three first inclined surfaces 1511 are coplanar, and cooperatively define a contour (not shown) matching with at least a part of the electronic device to provided cushioning for the electronic device. For convenience, the first protruding blocks 1512, 1514, and 1516 hereinafter will be referred to as "the first protruding blocks 151".

Two second protruding blocks 152 protrude from an inner surface of the base 15 and face the first sidewall 11. Each second protruding block 152 is arranged between two adjacent first protruding blocks 151. Each second protruding block 152 defines a second inclined surface 1521. The two second inclined surfaces 1521 are coplanar, and are parallel to the first inclined surfaces 1511. The second inclined surfaces 1521 also extend upwardly from the base 15 in a direction substantially the same as the direction the first sidewall 11 extends from the base 15. The distance between the second inclined surfaces 1521 and the first sidewall 11 is less than the distance between the first inclined surfaces 1511 and first sidewall 11, such that the second inclined surfaces 1511 is away from the electronic device when the first protruding blocks 151 are in an original state.

When the electronic device is subjected to an impact and the first protruding blocks 151 are pressed by the electronic device, the first protruding blocks 151 deform to absorb energy of impact. When the electronic device further contacts the second inclined surfaces 1521, the second protruding blocks 152 adapt to also absorb energy of the impact, and the second protruding blocks 152 also protect the first protruding blocks 151 from deforming too much and losing their ability to rebound.

Furthermore, a groove 153 is defined between each of the first and second protruding blocks 151, 152 and the first sidewall 11. The groove 153 provides a buffer space such that the first and second protruding blocks 151, 152 are deformable to absorb impacts.

Three third protruding blocks 1542, 1544, and 1546 protrude from the inner surface of the base 15 and face the third sidewall 13. For convenience, the third protruding blocks 1542, 1544, and 1546 hereinafter will generally be referred to simply as "the third protruding blocks 154". Two fourth protruding blocks 155 protrude from the inner surface of the base 15 and face the third sidewall 13. The structure and function of the third and fourth protruding blocks 154, 155 are similar to that of the first and second protruding blocks 151, 152 respectively. The third protruding blocks 154 are arranged corresponding to the first protruding blocks 151, and the fourth protruding blocks 155 are arranged corresponding to the second protruding blocks 152.

Three fifth protruding blocks 1562, 1564, and 1566 protrude from the inner surface of the base 15. The fifth protruding blocks 1562, 1564, and 1566 are substantially aligned in a line, and are sandwiched between the first and third protruding blocks 151, 154, and the second and fourth protruding blocks 152, 155. The fifth protruding block 1562 is adjacent to the second sidewall 12. The fifth protruding block 1566 is adjacent to the fourth sidewall 14. The fifth protruding block 1564 is sandwiched between the other two fifth protruding blocks 1562, 1566. A sixth protruding block 157 protrudes from the fifth protruding block 1562. A seventh protruding block 158 protrudes from the fifth protruding block 1564. A eighth protruding block 159 protrudes from the fifth protruding block 1566. The sixth, seventh, and eighth protruding blocks 157, 158, 159 support the top or bottom of the electronic device to be packed, thus, are able to absorb energy of impacts to the top or bottom of the electronic device. The sixth protruding blocks 157 define a groove 1572, such that the sixth protruding blocks 157 are substantially U-shaped. The seventh protruding block 158 defines an indicator 1582. The indicator 1582 is substantially an arrowhead for directing an operator to quickly pack the electronic device in the packing cushion 100 in a correct orientation.

It should be understood that a number of the first, second, third, and fourth protruding blocks 151, 152, 154, 155 are changeable according to shape of the electronic device to be packed. For similar considerations, a number of the protrusions 121, 141 are also changeable according to the shape of the electronic device.

When the packing cushion 100 is used, the electronic device to be packed is placed between the first and third protruding blocks 151,154 of the packing cushion 100. Because of the cushioning of the packing cushion 100, the electronic device is protected from shocks and vibrational impacts.

Figure 2:
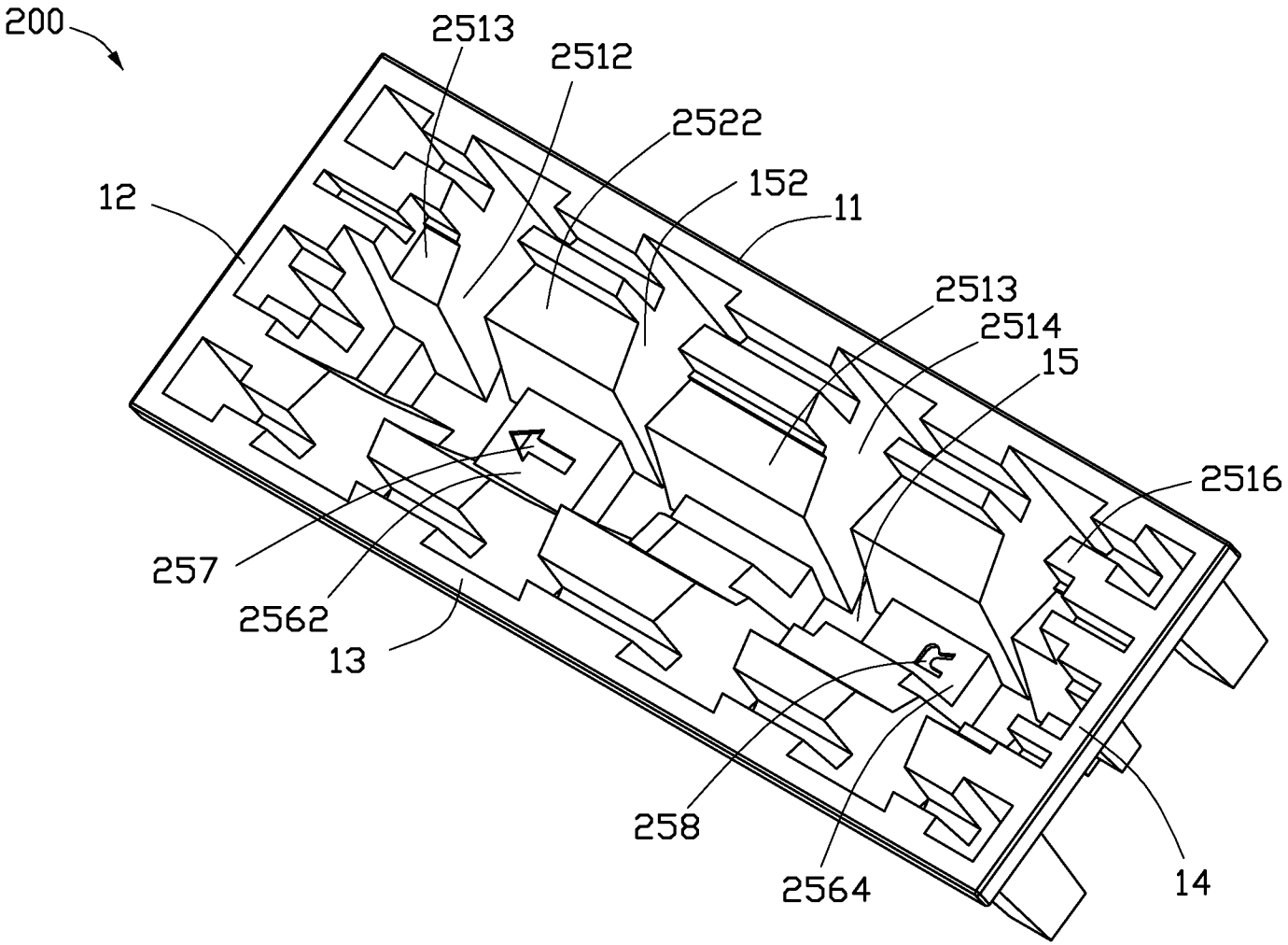
FIG. 2 is a perspective view of a packing cushion in accordance with another embodiment.

Referring to FIG. 2, a packing cushion 200 in accordance with another exemplary embodiment is shown. The packing cushion 200 is similar to the packing cushion 100. The difference between the packing cushion 200 and the cushion 10 are: Firstly, each of the first and second protruding blocks 151, 152 of the packing cushion 200 further define a first and a second sidesteps 2513, 2522 respectively. The first and second sidesteps 2513, 2522 are adjacent to the first and second inclined surfaces 2511, 2521 respectively. The first and second sidesteps 2513, 2522 define the contour to match with the electronic device to be packed. Secondly, two fifth protruding blocks 2562, 2564 protrude from the inner surface of the base 15. The fifth protruding blocks 2562 defines an arrowhead indicator 257, and the other fifth protruding block 2564 defines an R-shaped indicator 258.

When the packing cushion 200 is used, the electronic device to be packed is placed between the first and third protruding blocks 151, 154 of the packing cushion 200. Because of the cushioning of the protrusions 121,141, and the first, second, third, fourth, and fifth protruding blocks 151, 152, 154,155, 1562,1564 of the packing cushion 200, the electronic device is protected from shocks and vibrations of impacts.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A packing cushion for packing an object, the packing cushion comprising:

a base; and a plurality of sidewalls coupled to the base, the plurality of sidewalls interconnecting with each other and cooperating with the base to form an accommodating space;

wherein an inner surface of the base defines a plurality of first and second protruding blocks arranged adjacent to one of the sidewalls, each second protruding block is arranged between two adjacent first protruding blocks, a contour defined by the first protruding blocks matches with at least a part of the object to be packed, when the first protruding blocks are in an original state, the first protruding blocks contact with the object to act as a first cushioning, and the second protruding blocks contact with the object to act as a second cushioning when the first protruding blocks deform enough, wherein a groove within the accommodating space is defined between each the first and second protruding blocks and the sidewall adjacent to the first and second protruding blocks to provide a buffer space for when the first and second protruding blocks deform.

2. The packing cushion of claim 1, wherein the first protruding blocks are arranged in parallel.

3. The packing cushion of claim 1, wherein each first protruding block comprises a first inclined surface, each second protruding block comprises a second inclined surface parallel to the first inclined surface, the distance between the second inclined surface and the first sidewall is less than the distance between the first inclined surfaces and the first sidewall.

4. The packing cushion of claim 1, comprising a first sidewall, a second sidewall, a third sidewall opposite to the first sidewall, and a fourth sidewall opposite to the second sidewall, the first, second, third and fourth sidewalls serially interconnect with each other and cooperating with the base to form the accommodating space.

5. The packing cushion of claim 4, wherein a plurality of third and fourth protruding blocks protrude from the base, the third and fourth protruding blocks are arranged adjacent to the third sidewall, each fourth protruding blocks is arranged between two adjacent third protruding blocks, and the third and fourth protruding blocks are corresponding to the first and second protruding blocks respectively, the structure and function of the third and fourth protruding blocks are similar to that of the first and second protruding blocks respectively.

6. The packing cushion of claim 5, wherein a plurality of fifth protruding blocks protrude from an inner surface of the base and are adjacent to each second and fourth sidewalls, the fifth protruding blocks are arranged between the first protruding blocks and the corresponding third protruding blocks.

7. The packing cushion of claim 6, wherein a sixth protruding block protrudes from each fifth protruding block.

8. The packing cushion of claim 6, wherein an indicator is disposed on one of the fifth protruding blocks.

9. The packing cushion of claim 8, wherein the indicator comprises an arrowhead.

10. A packing cushion, comprising:

a base; and a plurality of sidewalls coupled to the base, the plurality of sidewalls interconnecting with each other and cooperating with the base to form an accommodating space;

wherein first and second cushion portions protrude from an inner surface of the base in the accommodating space and are arranged adjacent to one of the sidewalls, each second protruding block is arranged between two adjacent first protruding blocks, a groove within the accommodating space is defined between each the first and second protruding blocks and the sidewall adjacent to the first and second protruding blocks to provide a buffer space, the first cushion portion comprises a first inclined surface, the second cushion portion comprises a second inclined surface, the second inclined surface is sandwiched between the first inclined surface and the sidewall adjacent to the first and second cushion portions, a contour defined by the first inclined surface matches with at least a part of an object to be packed, when the object is packed in the accommodating space, the first inclined surface contacts with at least a part of the object to provide a first cushioning, and when the object is subjected to impact forces to deform the first cushion portion, the second inclined surface contacts with the object to provide a second cushioning.

11. The packing cushion of claim 10, comprising a first sidewall, a second sidewall, a third sidewall opposite to the first sidewall, and a fourth sidewall opposite to the second sidewall, the first, second, third, and fourth sidewalls serially interconnect with each other and cooperate with the base to form the accommodating space.

12. The packing cushion of claim 11, wherein the first and second cushion portions are adjacent to the first sidewall, a groove is defined between each the first and second cushion portions and the first sidewall.

13. The packing cushion of claim 10, wherein the second inclined surface is parallel to the first inclined surface.

14. The packing cushion of claim 11, wherein a plurality of third and fourth cushion portions protrude from the base and are arranged adjacent to the third sidewall, and the third and fourth cushion portions are corresponding to the first and second cushion portions respectively, and the structure and function of the third and fourth protruding blocks are similar to that of the first and second protruding blocks respectively.

15. The packing cushion of claim 14, wherein a plurality of fifth cushion portions protrude from an inner surface of the base, the fifth cushion portions are arranged between the first cushion portions and the corresponding third cushion portions.

* * * * *